US009541282B2

(12) United States Patent
Jones et al.

(10) Patent No.: US 9,541,282 B2
(45) Date of Patent: Jan. 10, 2017

(54) BOILER SYSTEM CONTROLLING FUEL TO A FURNACE BASED ON TEMPERATURE OF A STRUCTURE IN A SUPERHEATER SECTION

(71) Applicant: INTERNATIONAL PAPER COMPANY, Memphis, TN (US)

(72) Inventors: Andrew K Jones, Cincinnati, OH (US); David Fuhrmann, Milford, OH (US); Tim Carlier, Terrace Park, OH (US); Mark Sargent, Cincinnati, OH (US)

( * ) Notice: Subject to any disclaimer, the term of this patent is extended or adjusted under 35 U.S.C. 154(b) by 256 days.

(21) Appl. No.: 14/202,242

(22) Filed: Mar. 10, 2014

(65) Prior Publication Data

US 2015/0253003 A1 Sep. 10, 2015

(51) Int. Cl.

| | |
|---|---|
| ***D21C 11/10*** | (2006.01) |
| ***D21C 11/12*** | (2006.01) |
| ***F22G 5/00*** | (2006.01) |
| ***F22G 5/02*** | (2006.01) |
| ***F22G 1/04*** | (2006.01) |
| ***F22G 7/04*** | (2006.01) |
| ***F22B 21/34*** | (2006.01) |
| ***F22B 31/00*** | (2006.01) |
| ***F22B 37/56*** | (2006.01) |
| ***F01K 23/06*** | (2006.01) |
| ***F22B 35/00*** | (2006.01) |

(52) U.S. Cl.

CPC ..... *F22G 5/02* (2013.01); *D21C 11/10* (2013.01); *D21C 11/12* (2013.01); *F01K 23/064* (2013.01); *F22B 35/00* (2013.01)

(58) Field of Classification Search

None

See application file for complete search history.

(56) References Cited

U.S. PATENT DOCUMENTS

| | | | | |
|---|---|---|---|---|
| 2,416,462 A | | 2/1947 | Wilcoxson | |
| 2,819,702 A | * | 1/1958 | Koch | F22B 21/343 122/479.2 |
| 2,830,440 A | * | 4/1958 | Durham | F22G 5/12 122/479.2 |
| 2,832,323 A | | 4/1958 | Craig | |

(Continued)

FOREIGN PATENT DOCUMENTS

| | | |
|---|---|---|
| CA | 2387369 | 10/2009 |
| EP | 0071815 | 2/1983 |

(Continued)

*Primary Examiner* — Gregory Huson
*Assistant Examiner* — Eric Gorman
(74) *Attorney, Agent, or Firm* — Thomas W. Barnes, III

(57) ABSTRACT

A boiler system is provided comprising: a furnace adapted to receive a fuel to be burned to generate hot working gases; a fuel supply structure associated with the furnace for supplying fuel to the furnace; a superheater section associated with the furnace and positioned to receive energy in the form of heat from the hot working gases; and a controller. The superheater section may comprise a platen including a tube structure with an end portion and a temperature sensor for measuring the temperature of the tube structure end portion and generating a signal indicative of the temperature of the tube structure end portion. The controller may be coupled to the temperature sensor for receiving and monitoring the signal from the sensor.

21 Claims, 4 Drawing Sheets

(56) References Cited

U.S. PATENT DOCUMENTS 2,962,006 A * 11/1960 Blodgett ..... F22B 21/343 122/479.5
2,966,896 A * 1/1961 Vogler ..... F01K 7/24 122/1 B
3,028,844 A * 4/1962 Durham ..... F22G 5/04 122/479.1
3,040,719 A * 6/1962 Dickey ..... F22B 35/002 122/479.1
3,161,180 A * 12/1964 Durham ..... F22G 5/04 122/479.1
3,207,134 A * 9/1965 Miller ..... F22G 5/02 110/190
3,246,635 A * 4/1966 Powell ..... F22G 5/06 110/106
3,274,979 A * 9/1966 Petit ..... F28G 3/16 122/392
3,291,106 A * 12/1966 Palchik ..... F22B 35/00 122/479.1
3,362,384 A * 1/1968 Caracristi ..... F22G 5/16 122/479.1
3,364,903 A * 1/1968 Covell ..... F22B 35/086 122/479.1
3,439,376 A 4/1969 Nelson et al.
3,452,722 A * 7/1969 Evers ..... F22B 35/083 122/448.1
3,575,002 A * 4/1971 Vuia ..... F01K 3/181 122/1 R
3,955,358 A * 5/1976 Martz ..... F01K 13/02 122/451 S
3,965,675 A * 6/1976 Martz ..... F01K 13/02 122/406.4
3,974,644 A * 8/1976 Martz ..... F01K 9/04 122/479.1
4,004,647 A 1/1977 Forst et al.
4,028,884 A * 6/1977 Martz ..... F01K 23/108 60/39.182
4,031,404 A * 6/1977 Martz ..... F01K 23/108 122/479.1
4,037,469 A 7/1977 Nordstrom et al.
4,085,438 A 4/1978 Butler
4,099,384 A 7/1978 Stevens et al.
4,237,825 A * 12/1980 Kochey ..... F22B 35/00 122/347
4,339,998 A 7/1982 Finch
4,351,277 A 9/1982 Ryan et al.
4,359,800 A 11/1982 Ziels
4,375,710 A 3/1983 Hammond
4,377,134 A * 3/1983 Frey ..... F22G 5/02 122/479.3
4,380,843 A 4/1983 Sullivan et al.
4,411,204 A * 10/1983 Hamilton ..... F23C 9/003 110/106
4,421,067 A 12/1983 Krowech
4,422,882 A 12/1983 Nelson et al.
4,430,963 A 2/1984 Finet
4,454,840 A 6/1984 Dziubakowski
4,466,383 A 8/1984 Klatt et al.
4,475,482 A 10/1984 Moss et al.
4,488,516 A 12/1984 Bueters et al.
4,492,187 A 1/1985 Hammond
4,539,840 A 9/1985 Klatt et al.
4,565,324 A 1/1986 Rebula et al.
4,567,622 A 2/1986 Ziels
4,599,975 A 7/1986 Reeve et al.
4,621,583 A 11/1986 Kaski
4,716,856 A * 1/1988 Beisswenger ..... B01J 8/0055 110/245
4,718,363 A 1/1988 Williames
4,718,376 A 1/1988 Leroueil et al.
RE32,723 E 8/1988 Neundorfer
4,779,690 A 10/1988 Woodman
4,803,959 A 2/1989 Sherrick et al.
4,887,431 A * 12/1989 Peet ..... F22G 5/12 122/479.1
4,920,994 A 5/1990 Nachbar
4,957,049 A * 9/1990 Strohmeyer, Jr. ..... F01K 23/064 110/234
4,980,674 A 12/1990 Scheibel et al.
4,986,391 A 1/1991 Salmon
4,996,951 A 3/1991 Archer et al.
5,027,751 A 7/1991 Archer et al.
5,048,636 A 9/1991 Roehrs
5,050,108 A * 9/1991 Clark ..... F22B 35/18 122/511
5,063,632 A 11/1991 Clark et al.
5,065,472 A 11/1991 Carpenter et al.
5,090,087 A 2/1992 Hipple et al.
5,113,802 A 5/1992 Leblanc
5,181,482 A 1/1993 Labbe et al.
5,209,324 A 5/1993 Hogbacka
5,230,306 A 7/1993 Barringer et al.
5,237,718 A 8/1993 Brown
5,241,723 A 9/1993 Garrabrant
5,261,965 A 11/1993 Moslehi
5,267,533 A 12/1993 Smith
5,271,356 A 12/1993 Kling et al.
5,286,063 A 2/1994 Huston
5,299,533 A 4/1994 Johnston et al.
5,305,713 A 4/1994 Vadakin
5,320,073 A 6/1994 Silcott et al.
5,348,774 A 9/1994 Golecki et al.
5,353,996 A 10/1994 Gallacher et al.
5,365,890 A 11/1994 Johnston, Jr. et al.
5,375,771 A 12/1994 Jamelle et al.
5,379,727 A 1/1995 Kling et al.
5,398,623 A 3/1995 Lautenschlager et al.
5,416,946 A 5/1995 Brown et al.
5,423,272 A * 6/1995 Dunn, Jr. ..... F22B 37/008 110/264
5,423,483 A 6/1995 Schwade
5,429,076 A 7/1995 Johnston, Jr. et al.
5,477,683 A 12/1995 Persson
5,505,163 A 4/1996 Jameel
5,509,607 A 4/1996 Booher et al.
5,522,348 A * 6/1996 Tanaka ..... F22B 31/00 122/367.1
5,530,987 A 7/1996 Piccirillo et al.
5,549,079 A 8/1996 Johnston, Jr. et al.
5,549,305 A 8/1996 Freund
5,553,778 A 9/1996 Jameel et al.
5,605,117 A 2/1997 Moskal
5,606,924 A 3/1997 Martin et al.
5,615,734 A 4/1997 Hyp
5,619,771 A 4/1997 Minic
5,626,184 A 5/1997 Campbell et al.
5,663,489 A 9/1997 Thungstrom et al.
5,675,863 A 10/1997 Holden et al.
5,740,745 A 4/1998 Smyrniotis et al.
5,745,950 A 5/1998 Holden et al.
5,756,880 A 5/1998 Chen et al.
5,765,510 A 6/1998 Krowech et al.
5,769,034 A 6/1998 Zilka et al.
5,769,035 A 6/1998 Fiedler
5,778,830 A 7/1998 Wall
5,778,831 A 7/1998 Jameel
5,793,014 A 8/1998 Sobkowiak et al.
5,836,268 A 11/1998 Wall
5,894,806 A 4/1999 Smyrniotis et al.
5,920,951 A 7/1999 Piccirillo et al.
5,943,865 A * 8/1999 Cohen ..... B01D 53/8631 110/345
5,983,639 A 11/1999 Kral et al.
6,065,528 A 5/2000 Fierle et al.
6,073,641 A 6/2000 Bude et al.
6,105,590 A 8/2000 Martin et al.
6,109,096 A 8/2000 Chen et al.
6,170,117 B1 1/2001 Batt
6,178,924 B1 * 1/2001 Hakulinen ..... D21C 11/12 122/235.33
6,244,098 B1 6/2001 Chen et al.
6,321,690 B1 11/2001 Zilka et al.

(56) References Cited

U.S. PATENT DOCUMENTS

| | | | | |
|---|---|---|---|---|
| 6,323,442 | B1 | 11/2001 | Jones | |
| 6,325,025 | B1 | 12/2001 | Perrone | |
| 6,425,352 | B2 | 7/2002 | Perrone | |
| 6,431,073 | B1 | 8/2002 | Zilka et al. | |
| 6,437,285 | B1 | 8/2002 | Thomas et al. | |
| 6,575,122 | B2 | 6/2003 | Hipple | |
| 6,581,549 | B2 | 6/2003 | Stewart et al. | |
| 6,604,468 | B2 | 8/2003 | Zilka et al. | |
| 6,644,201 | B2 | 11/2003 | Zilka et al. | |
| 6,710,285 | B2 | 3/2004 | Brown et al. | |
| 6,715,499 | B2 | 4/2004 | Bartels et al. | |
| 6,725,911 | B2 | 4/2004 | Jayaweera et al. | |
| 6,736,089 | B1 | 5/2004 | Lefebvre et al. | |
| 6,755,156 | B1 | 6/2004 | Zilka et al. | |
| 6,764,030 | B2 | 7/2004 | Habib et al. | |
| 6,772,775 | B2 | 8/2004 | Ackerman et al. | |
| 6,782,902 | B2 | 8/2004 | Shover et al. | |
| 6,892,679 | B2 | 5/2005 | Jameel et al. | |
| 6,964,709 | B2 | 11/2005 | Matsumoto et al. | |
| 7,017,500 | B2 | 3/2006 | Jones | |
| 7,028,926 | B2 | 4/2006 | Habib et al. | |
| 7,055,209 | B2 | 6/2006 | Zalewski | |
| 7,204,208 | B2 | 4/2007 | Johnson et al. | |
| 7,267,134 | B2 | 9/2007 | Hochstein, Jr. et al. | |
| 7,341,067 | B2 | 3/2008 | Jones et al. | |
| 7,395,760 | B2 | 7/2008 | Zilka et al. | |
| 7,458,342 | B2 | 12/2008 | Lefebvre et al. | |
| 7,584,024 | B2 | 9/2009 | Wroblewski et al. | |
| 7,633,033 | B2 | 12/2009 | Thomas et al. | |
| 7,735,435 | B2 | 6/2010 | Eriksson et al. | |
| 9,091,182 | B2 * | 7/2015 | Labbe | F01K 7/40 |
| 2002/0043192 | A1 * | 4/2002 | Philippe | D21C 11/12 110/348 |
| 2004/0006841 | A1 | 1/2004 | Jameel et al. | |
| 2004/0226758 | A1 | 11/2004 | Jones et al. | |
| 2005/0199743 | A1 | 9/2005 | Hochstein et al. | |
| 2005/0252458 | A1 * | 11/2005 | Saviharju | D21C 11/12 122/17.1 |
| 2006/0065291 | A1 | 3/2006 | Jones et al. | |
| 2006/0236696 | A1 | 10/2006 | Saviharju et al. | |
| 2009/0090311 | A1 | 4/2009 | James et al. | |
| 2009/0151656 | A1 | 6/2009 | Jones | |
| 2010/0064470 | A1 | 3/2010 | Dahlen et al. | |
| 2010/0077946 | A1 * | 4/2010 | D'Agostini | F01K 3/20 110/345 |
| 2010/0101462 | A1 * | 4/2010 | Hayashi | F01K 13/02 110/190 |
| 2010/0199930 | A1 | 8/2010 | Tandra | |
| 2011/0011315 | A1 * | 1/2011 | Hayashi | F23C 9/003 110/345 |
| 2012/0270162 | A1 * | 10/2012 | Dahlhielm | F23N 1/002 431/12 |
| 2013/0152973 | A1 | 6/2013 | Jones | |
| 2014/0150825 | A1 * | 6/2014 | Hei en | F23J 3/023 134/18 |
| 2016/0025600 | A1 | 1/2016 | Carlier et al. | |

FOREIGN PATENT DOCUMENTS

| | | |
|---|---|---|
| EP | 0602244 | 6/1994 |
| EP | 0905308 | 9/1998 |
| EP | 1063021 | 12/2000 |
| EP | 2784477 | 1/2014 |
| GB | 802032 | 9/1958 |
| GB | 1022254 | 9/1962 |
| GB | 1376805 | 12/1974 |
| GB | 2271440 | 4/1994 |
| GB | 2428312 | 1/2007 |
| JP | 62278217 | 12/1987 |
| JP | 10274408 | 10/1998 |
| JP | 2003156211 | 5/2003 |
| RU | 2143087 | 12/1999 |
| SU | 1291031 | 2/1987 |
| SU | 464031 | 3/1989 |
| WO | 9305338 | 3/1993 |
| WO | 9827384 | 6/1998 |
| WO | 03104547 | 12/2003 |
| WO | 2006037018 | 4/2006 |
| WO | 2007028447 | 3/2007 |
| WO | 2008057039 | 5/2008 |
| WO | 2009139714 | 11/2009 |
| WO | 2010098946 | 9/2010 |
| WO | 2014068325 | 5/2014 |

* cited by examiner

BOILER SYSTEM CONTROLLING FUEL TO A FURNACE BASED ON TEMPERATURE OF A STRUCTURE IN A SUPERHEATER SECTION

FIELD OF THE INVENTION

The present invention relates to a boiler system comprising a controller for monitoring a temperature of a structure in a superheater section and controlling fuel provided to a furnace based on the monitored temperature.

BACKGROUND OF THE INVENTION

In a paper-making process, chemical pulping yields, as a by-product, black liquor, which contains almost all of the inorganic cooking chemicals along with lignin and other organic matter separated from the wood during pulping in a digester. The black liquor is burned in a recovery boiler. The two main functions of the recovery boiler are to recover the inorganic cooking chemicals used in the pulping process and to make use of the chemical energy in the organic portion of the black liquor to generate steam for a paper mill.

In a kraft recovery boiler, a superheater structure is placed in the furnace in order to extract heat by radiation and convection from the furnace gases. Saturated steam enters the superheater section, and superheated steam exits from the section. The superheater structure comprises a plurality of platens.

SUMMARY OF THE INVENTION

In accordance with a first aspect of the present invention, a boiler system is provided comprising: a furnace adapted to receive a fuel to be burned to generate hot working gases; a fuel supply structure associated with the furnace for supplying fuel to the furnace; a superheater section associated with the furnace and positioned to receive energy in the form of heat from the hot working gases, the superheater section comprising: at least one platen including at least one tube structure, the one tube structure having an end portion; and a temperature sensor for measuring the temperature of the tube structure end portion and generating a signal indicative of the temperature of the tube structure end portion; and a controller coupled to the temperature sensor for receiving and monitoring the signal from the sensor.

The controller may control an amount of fuel provided by the supply structure to the furnace based on the signal.

The controller may monitor the signal from the temperature sensor for rapid changes in temperature of the tube structure end portion.

Rapid changes in temperature of the tube structure end portion may comprise a monotonic increase in temperature of least about 25 degrees F. occurring over a time period of between about one to ten minutes and a monotonic decrease in temperature greater than zero in magnitude occurring over a time period of between about one to fifteen minutes.

The controller may increase an amount of fuel supplied by the supply structure to the furnace after the temperature of the tube structure end portion has experienced rapid changes.

The boiler system may further comprise a temperature measuring device for sensing the temperature of the working gases contacting the superheater section and generating a corresponding temperature signal to the controller.

The controller may control the amount of fuel provided by the supply structure to the furnace such that the temperature of the working gases is below a threshold temperature until the temperature of the tube structure end portion has experienced rapid changes.

The controller may increase an amount of fuel supplied by the supply structure to the furnace after the temperature of the tube structure end portion has experienced rapid changes.

The controller may request an operator to input a tube structure clearing verification signal after the temperature of the tube structure end portion has experienced rapid changes.

In accordance with a second aspect of the present invention, a monitoring system is provided for a boiler system. The boiler system may comprise a furnace adapted to receive a fuel to be burned to generate hot working gases, a fuel supply structure associated with the furnace for supplying fuel to the furnace, and a superheater section associated with the furnace and positioned to receive energy in the form of heat from the hot working gases. The superheater section may comprise at least one platen including at least one tube structure. The one tube structure may have an end portion. The monitoring system may comprise: a sensor for measuring the temperature of the tube structure end portion and generating a signal indicative of the temperature of the tube structure end portion; and a controller coupled to the sensor for receiving and monitoring the signal from the sensor.

The controller may monitor the signal from the temperature sensor for rapid changes in temperature of the tube structure end portion.

The controller may generate a request to an operator to input a tube structure clearing verification signal after the temperature of the tube structure end portion has experienced rapid changes.

The controller may increase an amount of fuel supplied by the supply structure to the furnace after the temperature of the tube structure end portion has experienced rapid changes and an operator has input a tube structure clearing verification signal.

The controller may increase an amount of fuel supplied by the supply structure to the furnace after the temperature of the tube structure end portion has experienced rapid changes and without requiring that an operator input a tube structure clearing verification signal.

In accordance with a third aspect of the present invention, a process is provided for monitoring a boiler system comprising a furnace for burning a fuel to generate hot working gases, a fuel supply structure for supplying fuel to the furnace, a superheater section comprising at least one platen including at least one tube structure, the one tube structure having an end portion, and a sensor for measuring the temperature of the tube structure end portion and generating a signal indicative of the temperature of the tube structure end portion. The process may comprise: monitoring the signal from the sensor, and controlling an amount of fuel provided to the furnace based on the signal.

Monitoring may comprise monitoring the signal from the temperature sensor for rapid changes in temperature of the tube structure end portion.

Controlling may comprise increasing an amount of fuel supplied by the supply structure to the furnace after the temperature of the tube structure end portion has experienced rapid changes.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which are shown by way of illustration, and not by way of limitation, specific preferred embodiments in which the invention may be practiced. It is to be understood that other embodiments may be utilized and that changes may be made without departing from the spirit and scope of the present invention.

Figure 1:
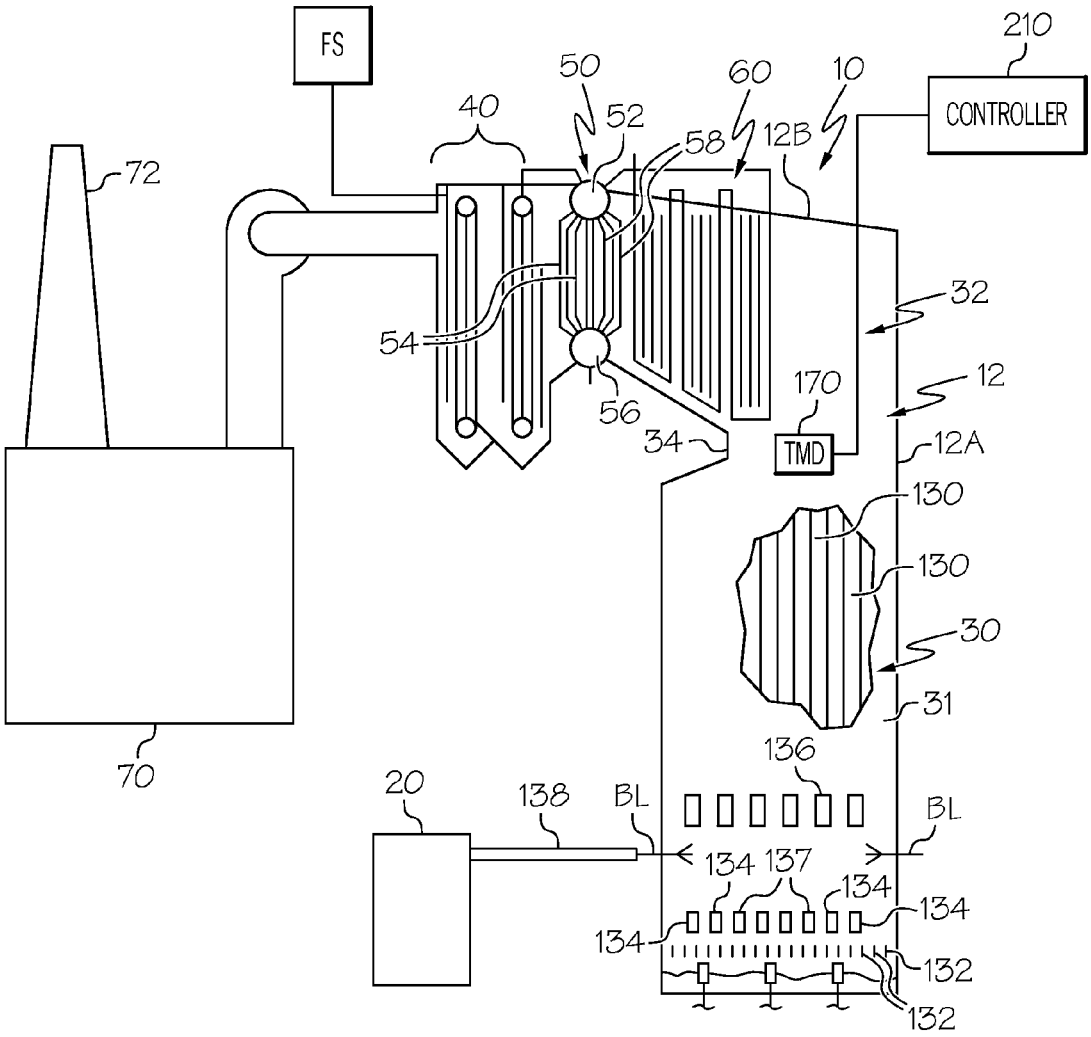
FIG. 1 is a schematic view of a kraft black liquor recovery boiler system constructed in accordance with the present invention.

FIG. 1 illustrates a kraft black liquor recovery boiler system 10 constructed in accordance with the present invention. Black liquor is a by-product of chemical pulping in a paper-making process. The initial concentration of "weak black liquor" is about 15%. It is concentrated to firing conditions (65% to 85% dry solids content) in an evaporator 20, and then burned in the recovery boiler system 10. The evaporator 20 receives the weak black liquor from washers (not shown) downstream from a cooking digester (not shown).

The boiler system 10 comprises a recovery boiler 12 comprising a sealed housing 12A defining a furnace 30 where a fuel, e.g., black liquor, is burned to generate hot working gases, a heat transfer section 32 and a bullnose 34 in between the furnace 30 and the heat transfer section 32, see FIG. 1. Hence, "hot working gases," as used herein, means the gases generated when fuel is burned in the furnace. The boiler system 10 further comprises an economizer 40, a boiler bank 50 and a superheater section 60, all of which are located in the heat transfer section 32, see FIG. 1. The hot working gases resulting from the burning of the fuel in the furnace 30 pass around the bullnose 34, travel into and through the heat transfer section 32, are then filtered through an electrostatic precipitator 70 and exit through a stack 72, see FIG. 1. It is noted that when the furnace 30 is initially fired, another fuel other than black liquor, such as natural gas or fuel oil, may be provided to the furnace 30 via injectors 137. Once the furnace 30 has reached a desired temperature, black liquor instead of natural gas or fuel oil may be used as the fuel in the furnace 30.

Vertically aligned wall tubes 130 are incorporated into vertical walls 31 of the furnace 30. As will be discussed further below, a fluid, primarily water, passes through the wall tubes 130 such that energy in the form of heat from the hot working gases generated in the furnace 30 is transferred to the fluid flowing through the wall tubes 130. The furnace 30 has primary level air ports 132, secondary level air ports 134, and tertiary level air ports 136 for introducing air for combustion at three different height levels. Black liquor BL is sprayed into the furnace 30 out of spray guns 138. The black liquor BL is supplied to the guns 138 from the evaporator 20. The injectors 137 and the spray guns 138 define fuel supply structure.

The economizer 40 receives feedwater from a supply FS. In the illustrated embodiment, the feedwater may be supplied to the economizer 40 at a temperature of about 250° F. The economizer 40 may heat the water to a temperature of about 450° F. The hot working gases moving through the heat transfer section 32 supply energy in the form of heat to the economizer 40 for heating the feedwater. The heated water is then supplied from the economizer 40 to a top drum (steam drum) 52 of the boiler bank 50, see FIG. 1. The top drum 52 functions generally as a steam-water separator. In the embodiment illustrated in FIG. 1, the water flows down a first set of tubes 54 extending from the top drum 52 to a lower drum (mud drum) 56. As the water flows down the tubes 54, it may be heated to a temperature of about 400-600° F. From the lower drum 56, a portion of the heated water flows through a second set of tubes 58 in the boiler bank 50 to the upper drum 52. A remaining portion of the heated water in the lower drum 56 is supplied to the wall tubes 130 in the furnace 30. The water flowing through the second set of tubes 58 in the boiler bank 50 and the wall tubes 130 in the furnace 30 may be heated to a saturated state. In the saturated state, the fluid is mainly a liquid, but some steam may be provided. The fluid in the wall tubes 130 is returned to the boiler bank 50 at the top drum 52. The steam is separated from the liquid in the top drum 52. The steam in the top drum 52 is supplied to the superheater section 60, while the water returns to the lower drum 56 via the first set of tubes 54.

In an alternative embodiment (not shown), the upper and lower drums 52, 56 may be replaced by a single drum, as is known to those skilled in the art, whereby steam is supplied by the single drum to a superheater section.

Figure 2:
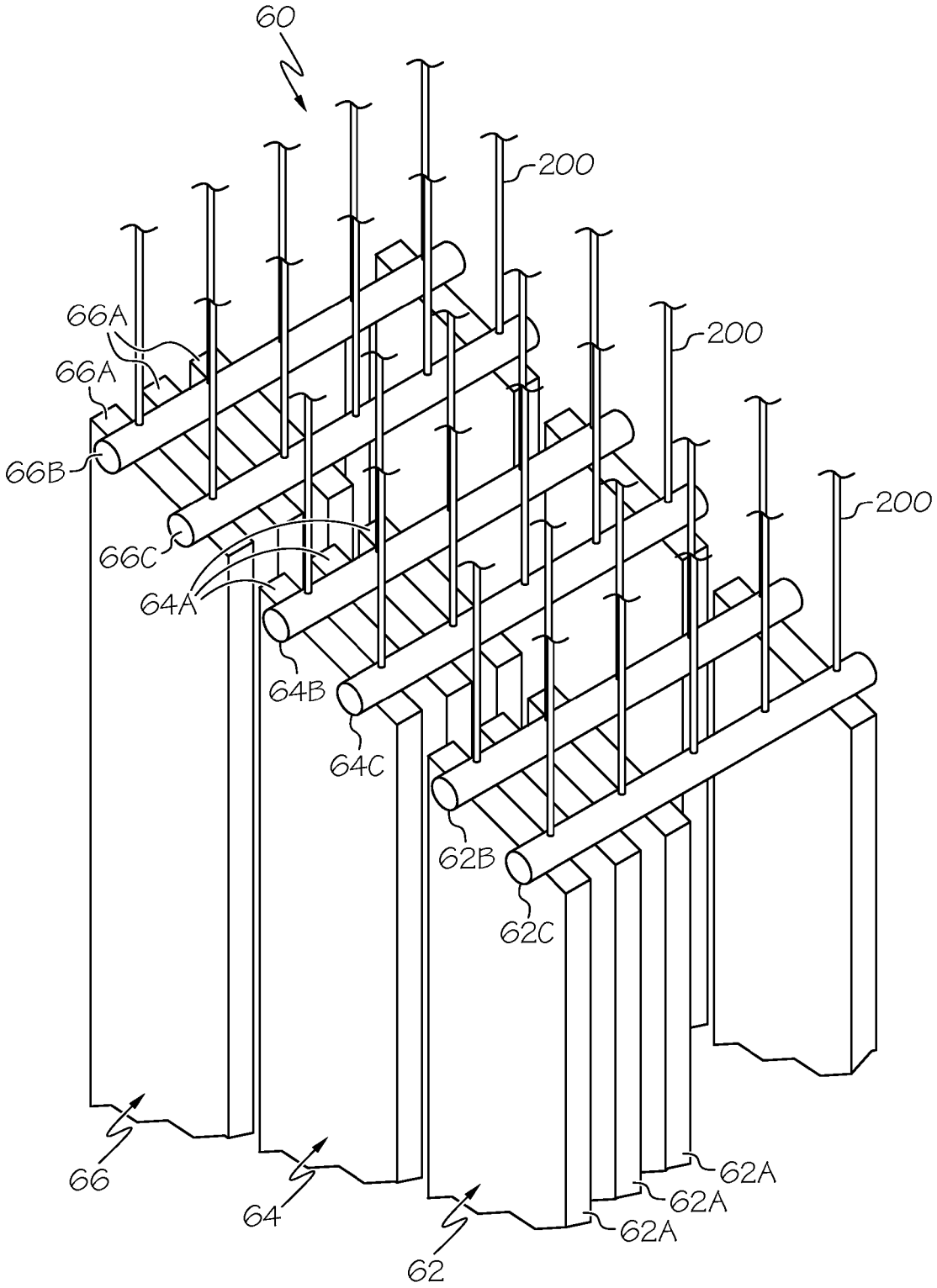
FIG. 2 illustrates a portion of a superheater section of the boiler system of FIG. 1; wherein tube structures defining platens are illustrated schematically as rectangular structures.

In the embodiment illustrated in FIG. 2, the superheater section 60 comprises first, second and third superheaters 62, 64 and 66, each of which may comprise between about 20-50 platens 62A, 64A and 66A. Steam enters the platens 62A, 64A and 66A through a corresponding manifold tube called an inlet header 62B, 64B and 66B, is superheated within the platens 62A, 64A and 66A, and exits the platens 62A, 64A and 66A as superheated steam through another manifold tube called an outlet header 62C, 64C and 66C. The platens 62A, 64A and 66A are suspended from the headers 62B, 64B, 66B, 62C, 64C and 66C, which are themselves suspended from overhead beams (not shown) by hanger rods 200. The hot working gases moving through the heat transfer section 32 supply the energy in the form of heat to the superheater section 60 for superheating the steam. It is contemplated that the superheater section 60 may comprise less than three superheaters or more than three superheaters.

Figure 3:
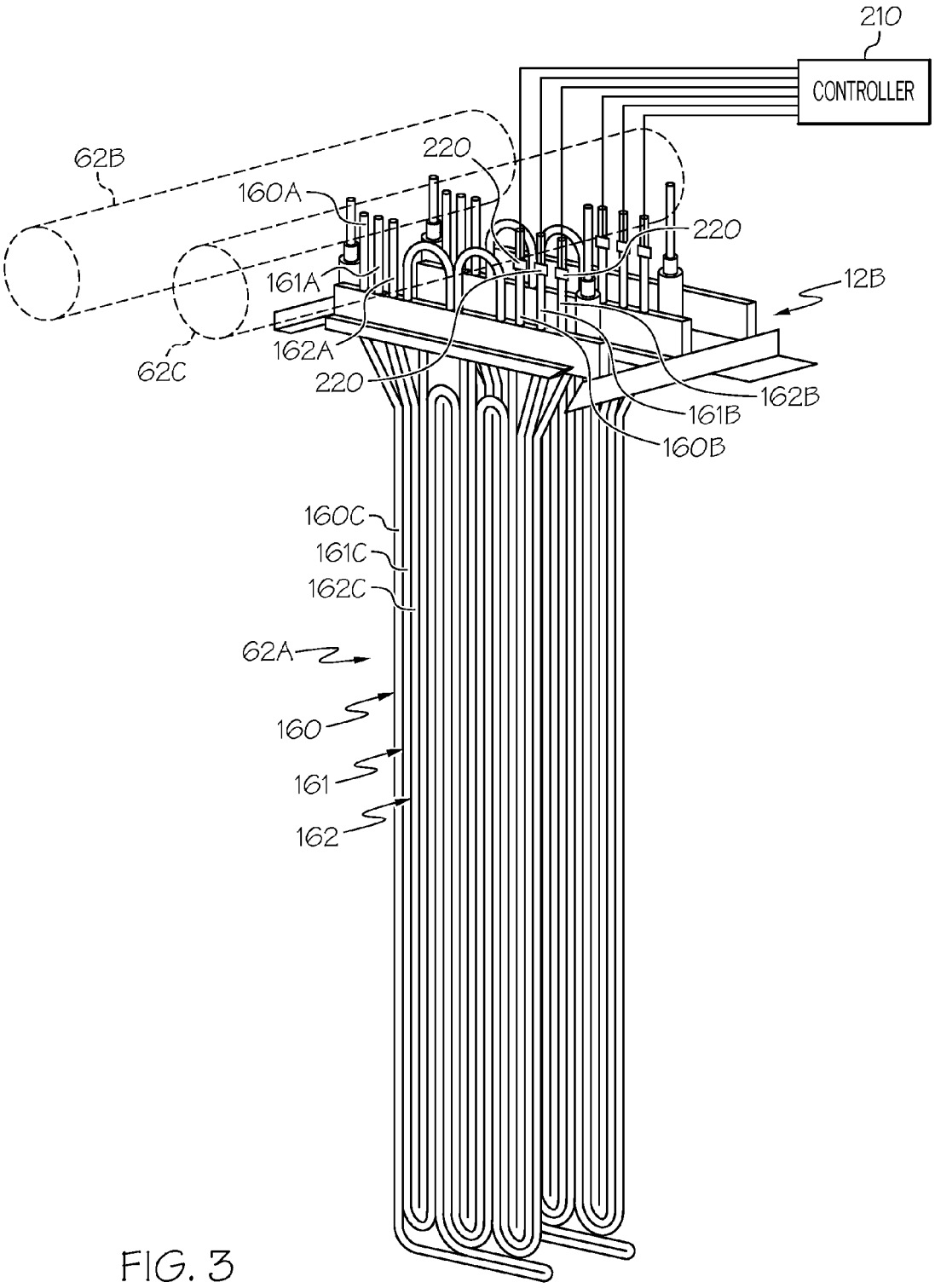
FIG. 3 illustrates first, second and third tube structures of a platen.

A platen 62A from the first superheater 62 is illustrated in FIG. 3. The remaining platens 62A in the first superheater 62 as well as the platens 64A and 66A in the second and third superheaters 64, 66 are constructed in generally the same manner. The platen 62A may comprise first, second and third separate metal tube structures 160-162, see FIG. 3. In FIG. 2, the platens are schematically illustrated as rectangular structures, but are defined by tube structures. The tube structures 160-162 comprise inlet portions 160A-162A, which communicate with the inlet header 62B and end portions 160B-162B, which communicate with the outlet header 62C. The tube structure inlet portions 160A-162A and end portions 160B-162B are located above a roof 12B of the boiler housing 12A, see FIGS. 1 and 3, while intermediate portions 160C-162C of the tube structures 160-162 extend within the boiler housing 12A and are located within the heat transfer section 32. The tube structures 160-162 define pathways through which fluid, e.g., steam, passes from the inlet header 62B, though the tube structures 160-162 and out the outlet header 62C. It is contemplated that the platen 62A may have less than or more than three tube structures, e.g., one, two, four or five tube structures.

The steam is heated to a superheated state in the superheater section 60. Prior to boiler/furnace start-up, cooled liquid water may settle in lower bends of the tube structures 160-162 in the platens 62A, 64A and 66A. Until the liquid water is boiled away during boiler/furnace start-up, the liquid water prevents steam from passing through the tube structures 160-162. The steam moving through the tube structures 160-162 functions as a cooling fluid for the metal tube structures 160-162. When no steam moves through a tube structure 160-162, the tube structure may become overheated, especially at an end portion 160B-162B, which may cause damage to the tube structure 160-162.

In the present invention, start-up of the furnace 30 is monitored by a controller 210 to ensure that the furnace 30 is heated slowly until any liquid water in the tube structures 160-162 of the superheater section platens 62A, 64A and 66A has safely evaporated before the furnace 30 is heated to an elevated state.

A temperature measurement device 170, which, in the illustrated embodiment, comprises an optical pyrometer, may be provided in or near the heat transfer section 32 to measure the temperature of the hot working gases in the heat transfer section 32 and entering the superheater section 60. The temperature measuring device 170 generates a corresponding temperature signal to the controller 210. The temperature sensed by the temperature measurement device 170 provides an indication of the amount of energy in the form of heat being generated by the furnace 30. Until the controller 210 has verified that liquid water in the tube structures 160-162 has been cleared, the amount of fuel provided by the injectors 137 or the spray guns 138 to the furnace 30 is controlled by the controller 210 at a low level. That is, in the illustrated embodiment, the amount of fuel provided by the injectors 137 or the spray guns 138 to the furnace 30 is controlled by the controller 210 such that the temperature of the hot working gases in the heat transfer section 32 and entering the superheater section 60, as measured by the temperature measuring device 170, is less than a predefined initial working gas threshold temperature, such as a threshold temperature falling within the range of 800-1000 degrees F., and preferably 900 degrees F. If the temperature of the hot working gases exceeds the threshold temperature, the amount of fuel provided to the furnace 30 is reduced. Once the controller 210 has verified that liquid water in the tube structures 160 has been cleared, then the controller 210 will allow the rate at which fuel is provided to the furnace 30 to increase such that the temperature of the hot working gases entering the superheater section 60 exceeds the threshold temperature.

The controller 210 comprises any device which receives input data, processes that data through computer instructions, and generates output data. Such a controller can be a hand-held device, laptop or notebook computer, desktop computer, microcomputer, digital signal processor (DSP), mainframe, server, other programmable computer devices, or any combination thereof. The controller 210 may also be implemented using programmable logic devices such as field programmable gate arrays (FPGAs) or, alternatively, realized as application specific integrated circuits (ASICs) or similar devices.

Preferably, for each of the tube structures 160-162 in the platens 62A, 64A and 66A, a temperature sensor 220, such as a thermocouple in the illustrated embodiment, is provided at the end portion 160B-162B of the tube structure 160 to measure the temperature of the tube structure 160-162 at that location, see FIG. 3. The temperature sensors 220 generate corresponding temperature signals to the controller 210. Each tube structure end portion 160B-162B is located near its corresponding outlet header. It is contemplated that a temperature sensor 220 may not be provided for all of the tube structures 160-162 in each of the platens 62A, 64A and 66A. However, it is preferred that a temperature sensor 220 is provided for at least one tube structure 160-162 in each platen 62A, 64A and 66A.

Liquid water evaporating in a tube structure 160-162 after furnace startup is referred to herein as a "tube structure clearing event." Such a tube structure clearing event is characterized by rapid changes in temperature at the end portion of the tube structure. In the illustrated embodiment, "rapid changes in temperature" of the end portion 160B-162B of a tube structure 160-162, as measured by a corresponding temperature sensor 220, are characterized by the temperature increasing monotonically, rapidly, e.g., over a 1-10 minute period, and significantly, e.g., by a temperature increase of at least 25 degrees F., and immediately thereafter, decreasing monotonically, rapidly, e.g., over a 1-15 minute period, by a temperature magnitude decrease equal to or less than the magnitude of the temperature increase but, in any event, the magnitude of the decrease in temperature is greater than zero.

Figure 4:
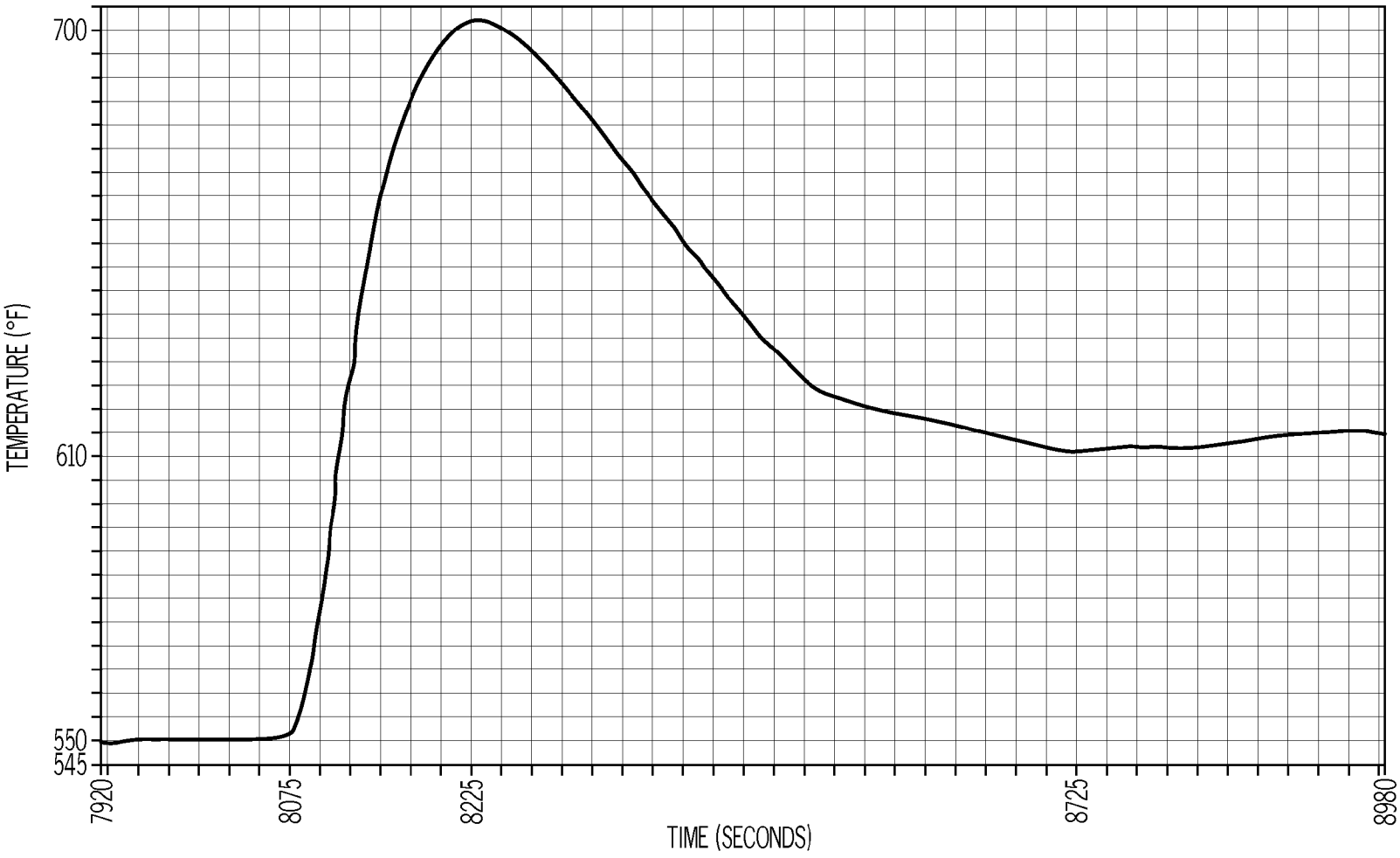
FIG. 4 is an example plot of a tube structure clearing event.

In FIG. 4, a plot is illustrated corresponding to a measured tube structure clearing event. As shown in FIG. 4, the temperature of a tube structure end portion, as measured by a corresponding temperature sensor 220, began to monotonically increase in temperature at about 8075 seconds from about 550 degrees F. to a maximum temperature of about 700 degrees F. at about 8225 seconds. Hence, over a time period of about 150 seconds, the tube structure end portion increased in temperature by about 150 degrees F. After reaching the maximum temperature at about 8225 seconds, the temperature of the tube structure end portion immediately began to decrease monotonically to a temperature of about 610 degrees F. at about 8725 seconds. Hence, over a time period of about 500 seconds, the tube structure end portion monotonically decreased in temperature by about 90 degrees.

Hence, the temperature sensors 220 are monitored by the controller 210 for rapid temperature changes, i.e., a rapid increased in temperature immediately followed by a rapid decrease in temperature, indicating that fluid is moving through the entire length of their corresponding tube structures 160-162. In the illustrated embodiment, once all of the temperature sensors 220 have provided signals indicating that rapid temperature changes have occurred at their corresponding tube structure end portions, the controller 210 may automatically cause (without input from an operator) the injectors 137 or spray guns 138 to increase the amount of fuel provided to the furnace 30 since the temperature of the hot working gases in the heat transfer section 32 and entering the superheater section 60 can safely exceed the predefined initial working gas threshold temperature (800-1000 degrees F. in the illustrated embodiment).

An "increase in the amount of fuel provided to the furnace" is intended to encompass increasing the rate at which fuel is input into the furnace 30 by either the injectors 137 or the spray guns 138. Hence, an increase in the amount of fuel provided to the furnace 30 may result when the injectors 137 increase the rate at which natural gas or fuel oil is input into the furnace 30; when the injectors 137 stop inputting natural gas or fuel oil while, at that same time, the spray guns 138 begin inputting black liquor into the furnace 30 at a rate which exceeds the rate at which natural gas or fuel oil was injected into the furnace 30; or when the spray guns 138 increase the rate at which black liquor is input into the furnace.

In accordance with a further aspect of the present invention, once all of the temperature sensors 220 have provided signals to the controller 210 indicating that rapid temperature changes have occurred at their corresponding tube structure end portions, the controller 210 may generate a message or otherwise indicate to an operator that a tube structure clearing event has occurred and/or request that the operator input a tube structure clearing verification signal. In an embodiment, the controller 210 will not automatically cause the injectors 137 or spray guns 138 to increase the amount of fuel provided to the furnace 30 once all of the temperature sensors 220 have provided signals to the controller 210 indicating that rapid temperature changes have occurred at their corresponding tube structure end portions, as is done by the embodiment discussed above. Instead, the controller 210 will wait until it receives a verification signal input from the operator, via a keypad, keyboard or other input device, indicating that the operator has verified that a tube structure clearing event has occurred. In this embodiment, only after receiving the verification signal input by the operator will the controller 210 cause the injectors 137 or spray guns 138 to increase the amount of fuel provided to the furnace 30. In another embodiment, without waiting to receive a verification signal input from the operator (but may occur before or after generating a message indicating to an operator that a tube structure clearing event has occurred, after being preferable), the controller 210 will automatically cause the injectors 137 or spray guns 138 to increase the amount of fuel provided to the furnace 30 once all of the temperature sensors 220 have provided signals to the controller 210 indicating that rapid temperature changes have occurred at their corresponding tube structure end portions, as is done in the embodiment discussed above.

The controller 210, temperature measuring device 170 and temperature sensors 220, as discussed above with regards to FIGS. 1 and 3, define a monitoring system for the boiler system 10.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A boiler system comprising:

a furnace adapted to receive a fuel to be burned to generate hot working gases;

a fuel supply structure associated with said furnace for supplying fuel to said furnace;

a superheater section associated with said furnace and positioned to receive energy in the form of heat from the hot working gases, said superheater section comprising:

at least one platen including at least one tube structure, the one tube structure having an end portion; and a temperature sensor for measuring the temperature of the tube structure end portion and generating a signal indicative of the temperature of said tube structure end portion; and a controller coupled to said temperature sensor for receiving and monitoring the signal from said temperature sensor.

2. The boiler system as set out in claim 1, wherein the controller controls an amount of fuel provided by the supply structure to the furnace based on the signal.

3. The boiler system as set out in claim 1, wherein said controller monitors the signal from said temperature sensor for rapid changes in temperature of said tube structure end portion.

4. The boiler system as set out in claim 3, wherein rapid changes in temperature of said tube structure end portion comprises a monotonic increase in temperature of least about 25 degrees Fahrenheit occurring over a time period of between about one to ten minutes and a monotonic decrease in temperature greater than zero in magnitude occurring over a time period of between about one to fifteen minutes.

5. The boiler system as set out in claim 3, wherein said controller increases an amount of fuel supplied by said supply structure to said furnace after the temperature of said tube structure end portion has experienced rapid changes.

6. The boiler system as set out in claim 1, further comprising a temperature measuring device for sensing the temperature of the working gases contacting said superheater section and generating a corresponding temperature signal to said controller.

7. The boiler system as set out in claim 6, wherein said controller controls the amount of fuel provided by said supply structure to said furnace such that the temperature of the working gases is below a threshold temperature until the temperature of said tube structure end portion has experienced rapid changes.

8. The boiler system as set out in claim 7, wherein said controller increases an amount of fuel supplied by said supply structure to said furnace after the temperature of said tube structure end portion has experienced rapid changes.

9. The boiler system as set out in claim 3, wherein said controller request an operator to input a tube structure clearing verification signal after the temperature of said tube structure end portion has experienced rapid changes.

10. A monitoring system for a boiler system comprising a furnace adapted to receive a fuel to be burned to generate hot working gases, a fuel supply structure associated with said furnace for supplying fuel to said furnace, a superheater section associated with the furnace and positioned to receive energy in the form of heat from the hot working gases, the superheater section comprising at least one platen including at least one tube structure, the one tube structure having an end portion, the monitoring system comprising:

a sensor for measuring the temperature of the tube structure end portion and generating a signal indicative of the temperature of the tube structure end portion; and a controller coupled to said sensor for receiving and monitoring the signal from said sensor.

11. The monitoring system as set out in claim 10, wherein said controller monitors the signal from said temperature sensor for rapid changes in temperature of said tube structure end portion.

12. The monitoring system as set out in claim 11, wherein rapid changes in temperature of said tube structure end portion comprises a monotonic increase in temperature of least about 25degrees Fahrenheit occurring over a time period of between about one to ten minutes and a monotonic decrease in temperature greater than zero in magnitude occurring over a time period of between about one to fifteen minutes.

13. The monitoring system as set out in claim 11, wherein said controller generates a request to an operator to input a tube structure clearing verification signal after the temperature of said tube structure end portion has experienced rapid changes.

14. The monitoring system as set out in claim 11, wherein said controller increases an amount of fuel supplied by said supply structure to said furnace after the temperature of said tube structure end portion has experienced rapid changes and an operator has input a tube structure clearing verification signal.

15. The monitoring system as set out in claim 11, wherein said controller increases an amount of fuel supplied by said supply structure to said furnace after the temperature of said tube structure end portion has experienced rapid changes and without requiring that an operator input a tube structure clearing verification signal.

16. The monitoring system as set out in claim 11, further comprising a temperature measuring device for sensing the temperature of the working gases contacting the superheater section and generating a corresponding temperature signal to said controller.

17. The monitoring system as set out in claim 16, wherein said controller controls the amount of fuel provided by said supply structure to said furnace such that the temperature of the working gases is below a threshold temperature until the temperature of said tube structure end portion has experienced rapid changes.

18. The monitoring system as set out in claim 17, wherein said controller increases an amount of fuel supplied by said supply structure to said furnace after the temperature of said tube structure end portion has experienced rapid changes.

19. A process for monitoring a boiler system comprising a furnace for burning a fuel to generate hot working gases, a fuel supply structure for supplying fuel to the furnace, a superheater section comprising at least one platen including at least one tube structure, the one tube structure having an end portion, and a sensor for measuring the temperature of the tube structure end portion and generating a signal indicative of the temperature of the tube structure end portion, the process comprising;

monitoring the signal from the sensor, and controlling an amount of fuel provided to the furnace based on the signal.

20. The process as set out in claim 19, wherein monitoring comprises monitoring the signal from the temperature sensor for rapid changes in temperature of the tube structure end portion.

21. The process as set out in claim 19, wherein controlling comprises increasing an amount of fuel supplied by the supply structure to the furnace after the temperature of the tube structure end portion has experienced rapid changes.

* * * * *